United States Patent [19]

Motter

[11] 3,960,675

[45] June 1, 1976

[54] METHOD FOR DEPLATING AND REPLATING ROTOGRAVURE CYLINDERS

[75] Inventor: John C. Motter, York, Pa.

[73] Assignee: Motter Printing Press Co., York, Pa.

[22] Filed: Apr. 17, 1975

[21] Appl. No.: 569,003

[52] U.S. Cl. ..... 204/25; 204/129.46; 204/129.65

[51] Int. Cl.[2] ..... C25D 7/04; C25F 3/00

[58] Field of Search ..... 204/25, 17, 129.46, 204/129.65, 32 R, 34

[56] References Cited

UNITED STATES PATENTS

| | | | |
|---|---|---|---|
| 1,918,627 | 7/1933 | Ballard | 204/25 |
| 2,373,087 | 4/1945 | Alger | 101/401.1 |
| 2,950,181 | 8/1960 | Bosman | 41/43 |
| 3,660,252 | 5/1972 | Giori | 204/17 |
| 3,741,835 | 6/1973 | Giori | 156/14 |

*Primary Examiner*—T. M. Tufariello
*Attorney, Agent, or Firm*—Brumbaugh, Graves, Donohue & Raymond

[57] ABSTRACT

A new printing surface is produced from an etched printing surface after previous printing use by applying insulative material into the etched wells of the printing surface, deplating metal from the printing surface while simultaneously scrubbing the excess insulative material even with the deplating surface, further deplating below the level of etching until a smooth surface is produced, and then replating metal back on to the desired thickness.

9 Claims, 7 Drawing Figures

METHOD FOR DEPLATING AND REPLATING ROTOGRAVURE CYLINDERS

BACKGROUND OF THE INVENTION

In intaglio and particularly in rotogravure printing, conventional methods for preparing a new printing surface from a previously etched one normally consists of either stripping, grinding, or replacing entirely the old printing surface.

In the still widely used Ballard process, disclosed in U.S. Pat. No. 1,831,645, a thin copper shell (usually about 0.006 inch thick) is formed over an insulating metal layer and bonded at the ends thereof to an underlying, rotogravure cylinder base. After etching and printing use, the etched shell is stripped off entirely, and a new copper shell is plated on as before to form a new printing surface.

The Ballard process, though convenient and quickly executed, is nevertheless uneconomical since the copper shells once stripped are of no further use and must be disposed of. Further, in plating on the new copper shell, copper anode bars of high purity must be used, and these bars are expensively fabricated. In addition, because each shell is usually plated on to a thickness of 0.006 inch, as compared to a depth of etching generally 0.002 inch deep, a greater possibility of error exists for producing a new rotogravure surface that is not perfectly cylindrical nor longitudinally linear than if a layer of substantially lesser thickness were otherwise to be plated on. Inasmuch as rotogravure speeds currently approach 1800–5000 ft./min., the rotogravure cylinder must be near perfectly true, or inaccuracies as small as 0.002 inch will cause wrinkling of and unevenness of tone in the printed matter.

An alternative method consists of grinding down the old printing surface below the level of the etching, and then replating metal to the desired thickness. Not only is this method time consuming, but also the resultant surface is far from smooth and often scored by particles loosened during grinding. Most importantly, this method using conventional equipment does not attain the high degree of cylndrical and linear trueness required for high speed rotogravure printing.

Another method for preparing an intaglio surface, disclosed in U.S. Pat. No. 2,373,087 to Alger, consists of etching a screen pattern onto the copper surface, filling the recesses of the screen pattern with insulative material, plating the grid lines of the screen pattern with chromium, removing the insulative material, and replating the recesses full with copper, which will adhere to the copper in the recesses but not to the chromium on the grid lines. Thereafter, an etched surface previously prepared in this manner can be reused for another impression simply by replating after use directly into the etched recesses.

It has been found, however, that the Alger method results in the etched recesses being replated to uneven heights, thereby requiring further grinding and polishing. In addition, use of a pre-formed chrome grid pattern precludes a printing surface prepared as above from being etched by the pecking stylus of heliokleishographic machines which are currently being introduced to and widely adopted in rotogravure.

SUMMARY OF THE INVENTION

The present invention is directed to producing a new printing surface from one previously etched in a manner which is convenient and economical, attains a high degree of surface trueness, and which is fully compatible with conventional machinery. Accordingly, this method comprises filling the etched wells of the printing surface with an insulative material, such as asphalt or an aromatic wax, immersing the printing surface in an electrolytic plating bath having disposed therein anodes of metal corresponding to the metal constituting the printing surface, deplating metal from the printing surface whie periodically and uniformly scrubbing with a scrubber the insulative material high points even with the deplating surface, further deplating metal until the deplating surface is reduced below the level of the etched wells and asphalt, i.e. until a smooth surface is attained, and then replating metal on the smooth surface to the desired thickness.

DESCRIPTION OF THE DRAWINGS

The further advantages and essential features of the present invention will become apparent from the detailed description below, read in conjunction with the drawings, of which.

DESCRIPTION OF THE PREFERRED EMBODIMENT

According to the present invention, a new printing surface is produced on a previously etched copper rotogravure cylinder as follows.

Figure 1A:
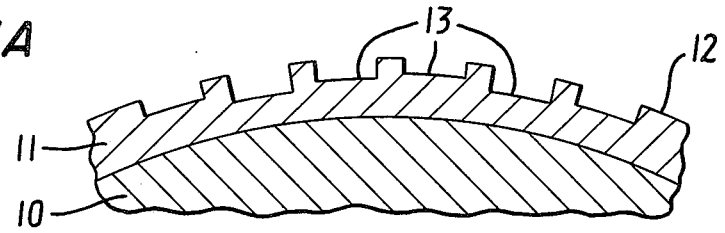
FIG. 1, parts A through E, are cross-sectional views (not to scale) of a portion of a rotogravure cylinder undergoing the deplating and replating method according to the invention.
Figure 1B:
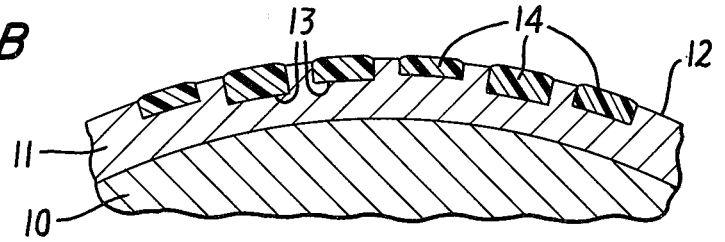
Figure 1C:
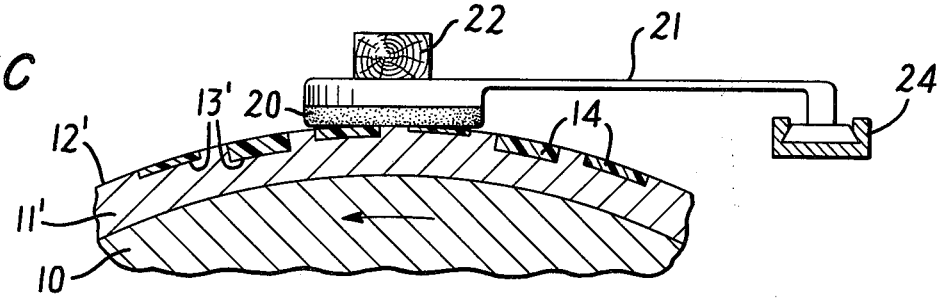

Referring to FIGS. 1A and 1B, a portion of a cross-section of a conventional rotogravure cylinder 10 is shown having a copper shell 11 formed thereon. The surface 12 of the copper shell 11 has been etched to form a plurality of wells 13 of various depths in accordance with standard techniques of intaglio printing. Although FIGS. 1A through 1E have, for the sake of clarity, not been drawn to scale, it will be understood by those skilled in the art that the copper shell is normally approximately 0.006 inch thick and the ink receiving wells may vary in depth from no depth at all up to about 0.002 inch.

Though not shown in the drawings, if the cylinder 10 had been chromed for durability during printing use, it is first dechromed by conventional deplating methods to expose the etched surface 12 of the copper shell 11. The etched wells 13 in the copper shell 11 are then filled with an insulative material such as asphalt or an aromatic wax (e.g., paraffin or beeswax). Asphalt may be conveniently applied in the form of asphaltum (an inexpensive and commercially available compound of asphalt and solvent) which forms a residue of asphalt in the etched wells 13 when the solvent dries. The excess insulative material is doctored off the unetched areas of the rotogravure cylinder so that generally the surfaces of the insulative material 14, in the etched wells 13, are flush with the cylinder surface 12.

Figure 2:
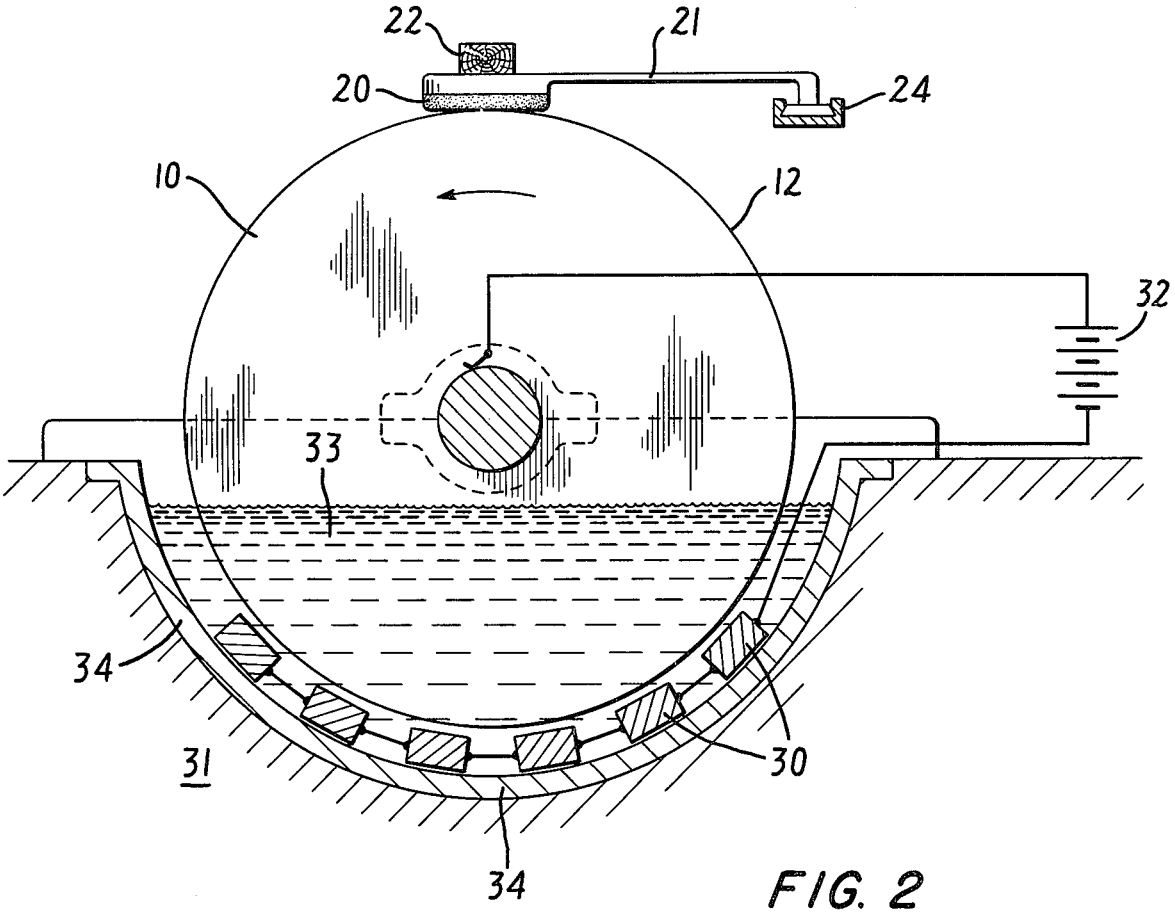
FIG. 2 is a side view of the cylinder in an electroplating bath, represented partly in cross-section.
Figure 3:
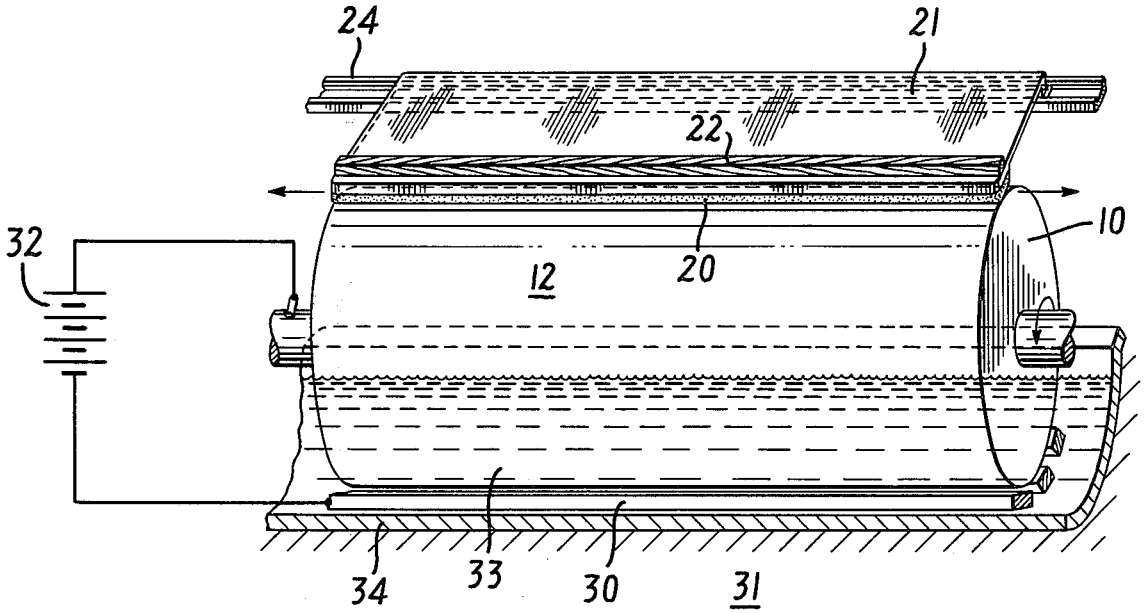
FIG. 3 is a front view of the cylinder in the electroplating bath of FIG. 2, represented partly in cross-section.

The cylinder 10, thus prepared, is then immersed in a conventional electroplating bath 31 (shown in FIGS. 2 and 3) used in the Ballard process, having a copper sulfate electrolyte solution 33, bottom and side walls 34 shaped in a halfcylinder corresponding to but of larger diameter than the immersed cylinder 10, and standard, 1×4 inch copper bars 30 arranged at the bottom of the bath parallel to the length of the cylinder and concentrically adjacent (usually within ¼ inch of) the surface 12 of the immersed copper cylinder 10.

A flexible support arm 21 is held at one end in a track 24 running parallel to the length of the cylinder 10 and has an abrasive surface 20 attached to its other end fabricated of fine sand grit (preferably 400–500 grit) or of abrasive cloth. The abrasive surface 20 rests against the surface of the cylinder 10 by gravity and is moved laterally to and fro in periodic motion (preferably 2–3 cycles/min.) during both the deplating and replating cycles. The pressure of the abrasive surface 20 on the cylinder 10 may be varied by adjusting weights 22 on the flexible support arm 21. The abrasive surface may extend beyond both ends of the cylinder in order that it remain in contact with the surface of the cylinder at all times despite the to and fro motion. In this manner the abrasive surface acts uniformly over the entire lateral length of the cylinder, and, because of the to and fro motion, copper particles trapped by the abrasive surface are prevented from scoring grooves into the surface of the cylinder when the cylinder is rotated as described further below.

With the cylinder 10 connected as an anode to a source of electrical potential 32, and the copper bars 30 as cathode, a current is applied to deplate copper from the cylinder surface. During deplating, the cylinder 10 is rotated in the copper sulfate solution 33 at a preferred rate of 50–60 rpm. A filter may be disposed in the bath 31 for removing copper and asphalt particles. To control the rate of deplating, the bath temperature, current density, and concentration (Baume°) of the copper sulfate solution may be adjusted for optimum results.

During deplating, the abrasive surface 20, in conjunction with the axial rotation of the cylinder 10, removes copper particles, copper oxide which may form on the cylinder surface, and copper sulfate foam carried up from the bath solution 33. More importantly, the abrasive surface 20 evenly scrubs the asphalt 14' in the etched wells 13' flush with the deplating cylinder surface 12' as the depth of the etched wells is reduced, as seen more clearly in FIG. 1C.

Figure 1D:
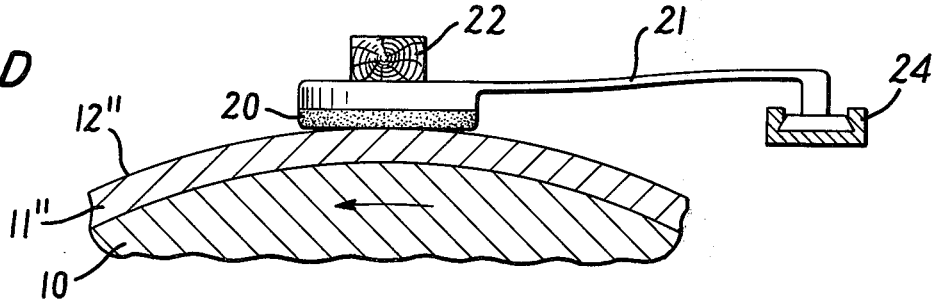
Figure 1E:
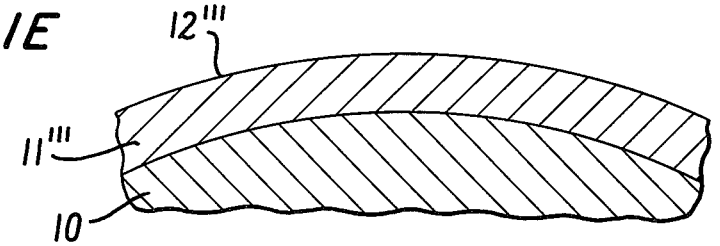

Deplating continues until the cylinder surface 12' has reduced below the bottoms of the etched wells 13' to produce a smooth copper surface 12'' in FIG. 1D. As the depth of rotogravure etching is generally at most 0.002 inch, deplating must continue until at least this amount is removed from the copper shell 11.

This method of deplating is relatively fast, saves deplated copper, which is collected on the cathodic copper bars for later replating use, and, further, has the great advantage of full operability with conventional electroplating equipment.

The polarity of the electrolytic bath 31 is now reversed, the cylinder 10 being cathodic and the copper bars 30 anodic, whereby copper is now replated evenly back onto the smooth copper surface 12'' produced in the deplating step. Once again, the cylinder 10 is rotated preferably at 50–60 rpm, and the abrasive surface 20 sweeps periodically (2–3 cycles/min.) to remove copper sulfate foam, copper particles, and any copper nodules which may form unevenly on the cylinder surface. The rate of replating is controlled by the bath temperature, current density, and the copper sulfate concentration.

Replating continues (usually adding about 0.002 inch of copper to the copper shell 11'') until the desired thickness is restored to the cylinder 10, thereby producing a new rotogravure printing surface 12''' (FIG. 1E) ready for etching. The thickness of copper replated to the cylinder 10 can be accurately controlled by regulating the temperature, the copper sulfate concentration (Baume°), current density, time, and the condition of the anodic copper bars 30. To ensure trueness and uniformity in the cylinder diameter, the above must be controlled very accurately.

As will be appreciated from the foregoing description, the method according to the present invention results in a new, smooth, copper printing surface of exceptional cylindrical and linear trueness produced quickly and inexpensively from conventional equipment. The high degree of trueness attained is especially important in color rotogravure, where each color roll must be near perfectly true and equal in diameter in order for the color patterns to register together during printing, and in high speed rotogravure printing, currently at rates of about 1800–5000 ft./min., at which speed the slightest unevenness will result in off-tracking and wrinkling of the printed web and uneven pressure of the doctor blade against the cylinder. Usually only 0.002 inch copper need be deplated and replated according to the present method, as compared to the 0.006 inch shell replated in the Ballard process, and this difference results in a substantial increase in the probabiity of achieving near perfect cyindrical and linear trueness of the newly formed printing surface.

The new printing surface prepared by the inventive method is ready for a new impression of rotogravure etching and needs no further grinding, burnishing, or polishing. Avoiding the need to polish the copper printing surface is an important advantage of this method because polishing can burnish the copper thereby affecting the acid etch. This method also has the further advantage of being fully compatible for use with the recently developed heliokleishographic etching machines, and may be used with any type of rotogravure cylinder or other intaglio printing surface.

It will be understood that the above described embodiments are merely exemplary and that persons skilled in the art may make variations and modifications without departing from the spirit and scope of the invention. All such modifications and variations are intended to be within the scope of the invention as defined in the appended claims.

I claim:

1. A method for producing a new printing surface from an intaglio printing surface previously etched for printing use, comprising the steps of:

a. filling the etched wells of said printing surface with an insulative material;

b. deplating metal from said printing surface, while simultaneously scrubbing the insulative material high points even with the deplating surface, until the deplating surface is reduced below the level of the etched wells, thereby obtaining a smooth metal surface; and c. replating metal on said smooth surface to the desired thickness.

2. The method as described in claim 1, in which said intaglio printing surface is a rotogravure cylinder having a surface layer of copper at least as thick as the depth of etching.

3. The method as described in claim 2, in which said rotogravure cylinder is rotated in an electrolytic bath during deplating and replating, said electrolytic bath having electrodes of copper operatively disposed therein.

4. The method as described in claim 3, in which said rotogravure cylinder is rotated at the rate of approximately 50–60 rpm.

5. The method as described in claim 3, in which said scrubbing step includes the step of moving a scrubber across said printing surface, said scrubber consisting of an abrasive surface including abrasive material carried by a flexible support arm, said abrasive surface bearing against said rotating rotogravure cylinder by gravity and moving laterally across the length of said cylinder in periodic and uniform motion.

6. The method as described in claim 5, in which said periodic motion consists of moving laterally across the length of the cylinder at the rate of approximately 2–3 cycles/min.

7. The method as described in claim 5, in which said abrasive material is selected from the group consisting of fine sand grit and abrasive cloth.

8. The method as described in claim 1, in which said insulative material is selected from the group consisting of asphalt and an aromatic wax.

9. The method as described in claim 8, in which said aromatic wax is selected from the group consisting of paraffin and beeswax.

* * * * *